United States Patent [19]

Gratsch

[11] Patent Number: 4,529,186

[45] Date of Patent: Jul. 16, 1985

[54] CLOTH SPREADING MACHINE WITH VACUUM TRANSPORT BELT FOR CONDENSING CLOTH

[76] Inventor: Jack M. Gratsch, 6220 Britton Ave., Cincinnati, Ohio 45227

[21] Appl. No.: 642,378

[22] Filed: Aug. 20, 1984

Related U.S. Application Data

[63] Continuation-in-part of Ser. No. 392,723, Jun. 28, 1982, abandoned.

[51] Int. Cl.[3] ..... B65H 29/46

[52] U.S. Cl. ..... 270/31

[58] Field of Search ..... 270/30–31; 101/382 MV

[56] References Cited

U.S. PATENT DOCUMENTS

| | | | |
|---|---|---|---|
| 3,479,023 | 11/1969 | Martin, Sr. et al. | 270/31 |
| 3,672,661 | 6/1972 | Gerber et al. | 270/31 |
| 3,684,273 | 8/1972 | Benson et al. | 270/31 |
| 3,782,649 | 1/1974 | Frederick et al. | 270/31 |
| 3,817,513 | 6/1974 | Frederick | 270/31 |
| 4,339,118 | 7/1982 | Burton et al. | 270/31 |
| 4,355,794 | 10/1982 | Costigan | 270/31 |
| 4,380,330 | 4/1983 | Smith | 270/31 |
| 4,477,065 | 10/1984 | Smith | 270/31 |

*Primary Examiner*—E. H. Eickholt
*Attorney, Agent, or Firm*—Frost & Jacobs

[57] ABSTRACT

A machine for spreading cloth from a roll upon an elongated table having a frame with wheels mounted on the table for longitudinal movement thereon, a cloth supply feed mechanism mounted on the frame and including an expansible perforated endless belt for conveying the cloth from the roll, means to support the roll of cloth, means for drawing a vacuum through said first belt to maintain alignment of the cloth thereon, the endless first belt having a portion capable of condensing the cloth and a spreader unit mounted on the frame for receiving the cloth from the cloth condensing portion of the first belt and depositing the cloth on the table.

30 Claims, 5 Drawing Figures

CLOTH SPREADING MACHINE WITH VACUUM TRANSPORT BELT FOR CONDENSING CLOTH

The present application is a continuation-in-part of U.S. Ser. No. 06/392,723, filed June 28, 1982 and now abandoned.

BACKGROUND OF THE INVENTION

1. Field of the Invention

This invention relates to cloth spreading machines, and more particularly to cloth spreading machines of the type which move reciprocably longitudinally over a cloth spreading table and spread layers of cloth upon the table.

2. Prior Art

Reciprocating cloth spreaders are well known in the art, having been in use for many years. The U.S. patents to Martin, et al. (U.S. Pat. No. 3,479,023) and Benson, et al. (U.S. Pat. No. 3,684,273) illustrate the general features of this type of machine. In laying or spreading cloth from a roll, the ideal situation is to put down a layer of cloth which is straight, smooth (flat) and tension free so that material usage is maximized.

Tension exists in a roll of cloth due to the manner in which the cloth is rolled up at the textile mill. Certain prior art workers have directed their efforts toward producing a tension free lay of cloth; the U.S. patents to Benson, et al. (U.S. Pat. No. 3,684,273) and Frederick, et al. (U.S. Pat. No. 3,782,649) underscore this fact. However, solutions proposed to date have been largely unsatisfactory. The mechanisms devised generally sense the tension of the web of cloth as it is being unrolled and spread; an appropriate adjustment is made in the speed of the cloth removal according to the conditions sensed. The problem lies in that these devices generally operate on an "on-off" system so that the response to overfeeding or underfeeding is abrupt and jerky. Although efforts have been made to smooth out this movement, as in U.S. patent to Benson, et al. (U.S. Pat. No. 3,684,273), for example, the prior art does not disclose a truly effective means for eliminating the tension.

Another problem rests in producing a lay of cloth with a straight edge, so that as layers of cloth are built up on the spreading table, the edges of the web will property align and waste of material will be minimized. Various factors contribute to this problem, including tight or loose selvage in the material that produces an arc or curve in the web of cloth and a tapered roll of cloth that results from improper winding at the mill. In an attempt to control these variables, machines typically incorporate some type of steering mechanism to act in conjunction with an edge position sensor, such as a photo-electric eye, and adjust the position of the roll accordingly as shown in U.S. patent to Martin, et al. (U.S. Pat. No. 3,479,023). However, these devices fall short of the desired result. Typically, the position of the cloth is adjusted a significant distance from the point at which the cloth meets the table; this distance may allow the cloth to move out of alignment before it reaches the table. In addition, the prior art devices generally move the roll by moving the rod which carries the roll of material. For large rolls of slick material, silk for example, the center of the roll may move, but the material coming off the roll slips over the underlying cloth and remains out of alignment.

Prior art devices are also unsatisfactory in the manner in which large rolls of cloth are loaded onto and driven by the cloth spreading machine. If the entire weight of the roll of cloth rests on a single driver, the cloth tends to tear or deform and be improperly fed. Prior art devices have attempted to control the weight against any one driver by using multiple drivers or providing partial overhead support for the weight of the large roll. However, these methods greatly increase the complexity and related cost of manufacture of cloth spreading machine.

SUMMARY OF THE INVENTION

The cloth spreading machine of the present invention is designed to produce a tensionless, in-line lay of cloth. In particular, cloth having a selvage tends to spread from a machine in a curved manner in that the cloth curves to the selvage side. To this end, the present invention has means for conveying the cloth in a tensionless manner to the table, which incorporates a vacuum, a perforated, expansible belt, various feed and tension adjustment rollers and an edge control means. Material from a roll of cloth contacts the feed rollers, passes through the edge control and is drawn to the expansible belt by a vacuum. A difference in circumferential speed of tension adjustment rollers which carry the belt is used to produce a contraction section within the belt. Since the belt is perforated, the cloth is tightly drawn against the belt by the vacuum and passes through the contraction area; the tension in the web of cloth is eliminated and a smooth lay is produced.

The vacuum system also maintains the straight edge alignment of the lay. As the web of cloth is drawn from the roll, the edge position is sensed and adjustments are made to correct the position of the cloth prior to its contact with the belt. The cloth remains in contact with a belt/vacuum arrangement until it makes contact with either the spreading table or a previous lay of cloth on the table.

A further feature of the present invention is the provision of an angled loader or feeder throat for the roll of cloth. The throat is in line with a feed roller, but is at a slight angle to the horizontal. The angle of the throat is such that the majority of the weight of the roll is supported by the throat. The remainder of the weight of the roll is sufficient to maintain the necessary pressure against the feed rollers.

DETAILED DESCRIPTION

Figure 1:
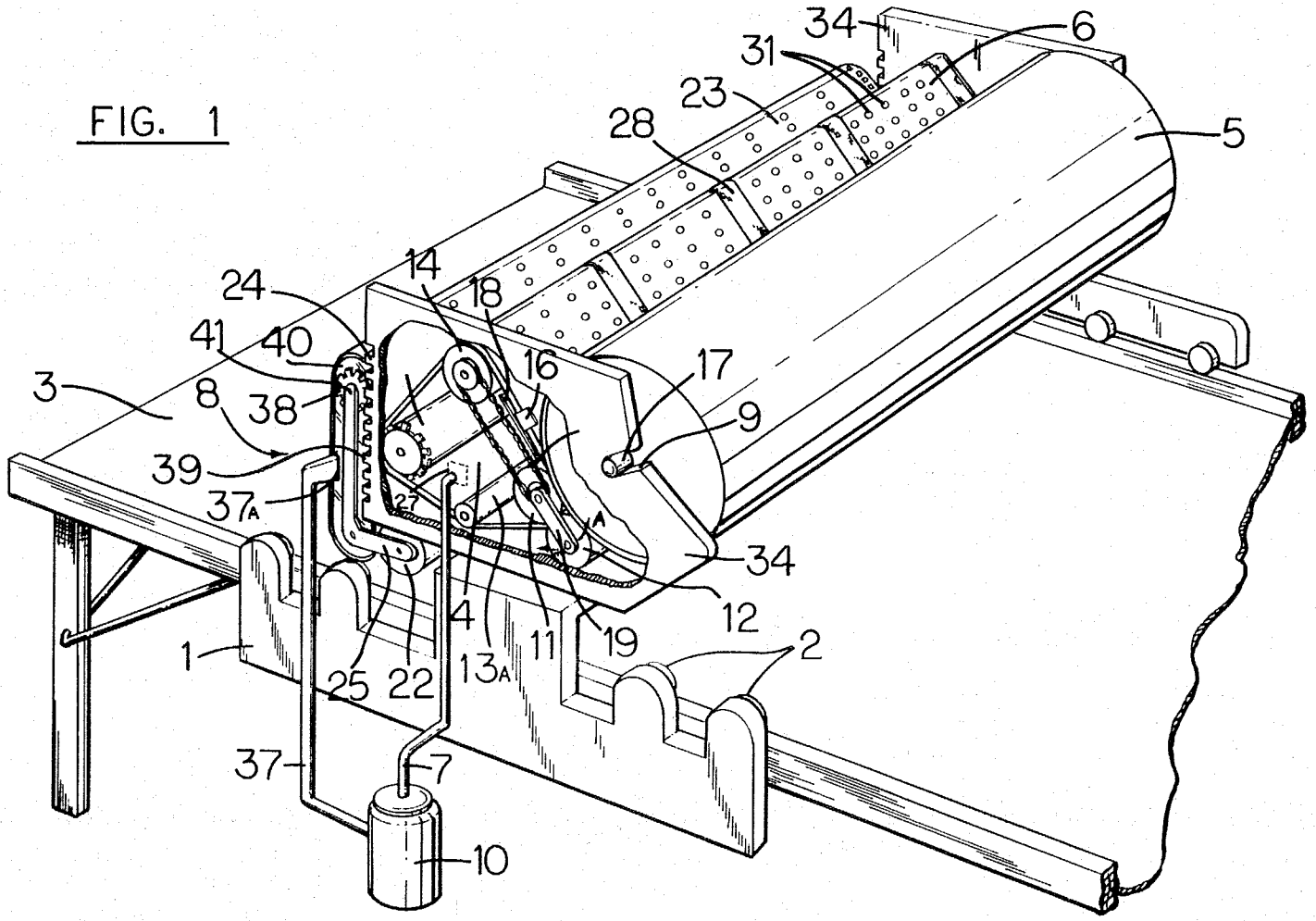
FIG. 1 is a semi-diagrammatic, fragmentary perspective view of the cloth spreading machine of the present invention mounted on a spreading table.

As shown in FIG. 1, the cloth spreader of the present invention has a frame 1 mounted on wheels 2 for longitudinal movement over a spreading table 3. The wheels 2 are in tandem to eliminate table joint clicks, give positive traction at all times, and provide better movement of the frame 1. Mounted centrally on the frame 1 is a cloth supply feed mechanism, generally indicated at 4, that is rotatable about a vertical axis with respect to the frame 1 and provides support for a roll 5 of cloth. A web 6 of cloth is fed from the roll 5 through the feed mechanism 4, to a spreading unit, generally indicated at 8, where the cloth web 6 is spread upon the spreading table 3 in layers. The frame 1 is caused to move longitudinally over the table 3 by conventional means, such as by driving the wheels 2 through a chain and sprocket transmission (not shown) powered by a drive motor (not shown).

The cloth supply feed mechanism 4 includes a loader throat 9, two feed rollers 11 and 12, two tension adjustment rollers 13*a* and 13*b*, a perforated carrier roller 14, a perforated expansible belt 15, means for drawing a vacuum (comprising a conduit 7 connected to a vacuum source 10) and edge control means 16. The loader throat 9 is essentially a slot-like channel formed in side walls 34 and designed to carry a center rod 17 which supports the roll 5 of cloth. The throat 9 is slightly inclined to use the force of gravity to advance the roll 5 against feed roller 11 as the web 6 is removed and the roll 5 gets smaller. However, the angle of inclination is limited so that a heavy roll will not exert so great a force on the feed roller 11 so as to damage the cloth as it is removed.

The belt 15 encircles the two tension adjustment rollers 13*a* and 13*b*, the perforated carrier roller 14 and the feed roller 11. As shown diagrammatically in FIG. 2, rollers 11, 13*b* and 14 are positioned in a fixed triangular relationship, while the position of roller 13*a* is adjustable along the path indicated by arrow B. Roller 11 is driven by a direct power source, such as motor 32. Rollers 11 and 14 are interconnected by a chain 29 and sprockets 30 and 30*a* so that roller 14 is also driven, and so that rollers 11 and 14 will always rotate at the same speed. Roller 13*a* is an idler roller and freely rotates with the movement of the belt 15. Roller 13*b* also rotates with the belt 15 but has its rotational speed limited by a frictional clutch 33, shown diagrammatically in FIG. 2. Frictional clutch 33 may take any convenient and conventional form, and may even constitute a disk brake system or a torque converter. Thus, roller 13*b* will rotate only as fast as it is pulled by the belt 15. There is sufficient friction between the rollers 11, 13*a*, 13*b* and 14 and the belt 15 so that there is no slippage.

The belt 15 is described as expansible since it is necessary that the tension within the belt vary. When roller 13*a* is in an extreme lower position, as indicated by the broken outline at 13*a'* in FIG. 2, the belt 15 is fully expanded; in this configuration, the belt 15 is, in a sense, inexpansible since it can be stretched no further, and the tension is uniform in the belt. To create the desired contraction section within the belt 15, roller 13*a* is moved from the position 13*a'* to that shown at 13*a* in solid lines. since there is no slippage between the rollers and the belt 15, the additional length released by moving roller 13*a*, initially creates a contraction section in the belt 15 between rollers 13*b* and 11. However, this "slackness" will cause the clutch mechanism in roller 13*b* to create a braking action and briefly decrease the rotational speed of roller 13*b*; this, in turn, causes the contraction to transfer to that section of the belt 15 between rollers 13*b* and 14. When the belt returns to its fully expanded condition between rollers 13*b* and 11, roller 13*b* will increase in rotational speed back to that of rollers 11 and 14, such that the contraction section of the belt remains between rollers 13*b* and 14.

Figure 3:
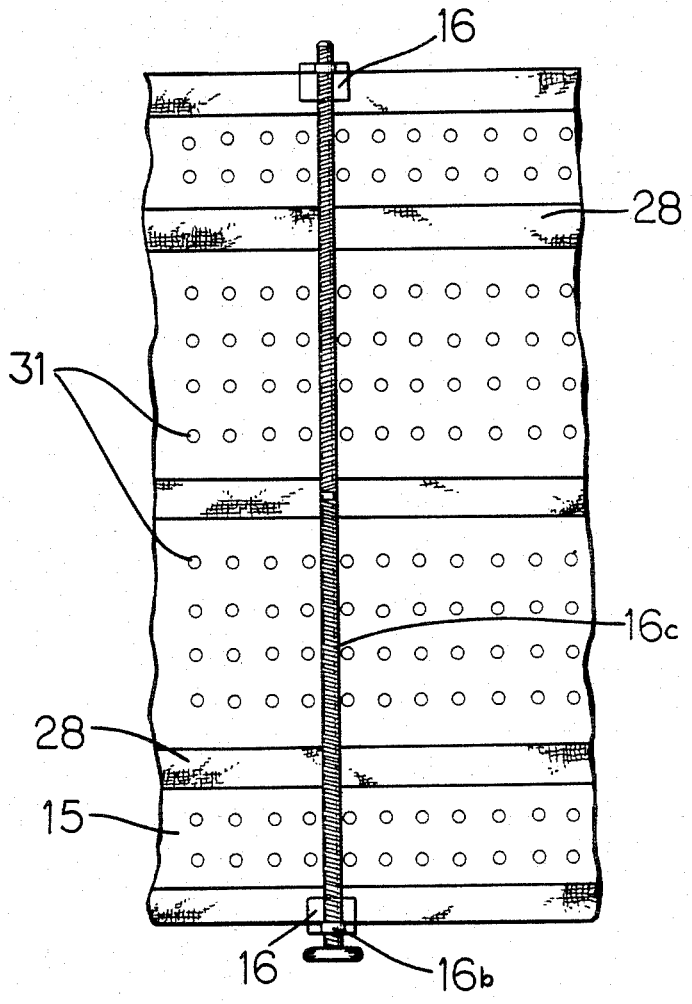
FIG. 3 is a fragmentary plan view of the endless belt of the cloth supply feed mechanism.

Preferably, the belt is made of perforated elastic, perforated rubber or other similar perforated flexible material which permits a vacuum to be drawn through the belt, and will accomplish the necessary expansion and contraction. As illustrated in FIG. 3, the belt 15 has continuous limit straps 28, generally made of nylon, which are attached to the belt by zig-zag stitching or in any other suitable manner. Of course, the limit straps can be made of other synthetic type materials, such as rayon, dacron, or the like. The position of the limit strips on the belt 15 limits the ability of the belt to stretch and expand. The zig-zag stitching permits the limit straps to relax when the belt is less than fully expanded. The zig-zag stitching also permits the belt to expand to the limit of the straps without ripping the limit straps from the belt. In general, the position and exact number of limit straps depend upon the size of the cloth spreading machine. However, there is an advantage to having the edges of the belt terminate with limit straps, particularly when the rollers have slight grooves corresponding to the position of the limit straps. In such a situation, the limit straps and grooves help assure proper positioning of the belt as it traverses the rollers, because the belt will not tend to shift to the right or left.

In addition to the above characteristics, the belt is also permeable or porous due to openings 31 so that a vacuum may be drawn through the belt. Thus, any material placed upon the belt will be held in place by means of the vacuum, even if the belt changes its course of direction.

A vacuum means 10, including conduit 7, is provided to draw a vacuum from the volume defined by the expansible belt 15 and the side walls 34 through an opening 28 in one of the sidewalls 34. The belt 15 and roller 14 are perforated to allow ambient air to be drawn therethrough by the vacuum means. During the cloth spreading operation, it is preferred that the vacuum means only pull air through the roller 14 and the section of the belt 15 between rollers 14 and 13*b* (the contraction section of the belt 15). However, it may also be desirable to draw a vacuum between rollers 11 and 14 at the time of initial thread-up. This is done by means of an openable and closable shutter 18 positioned beneath the belt 15 and between rollers 11 and 14 so that the vacuum means may draw air through this section to aid in the threading of the web 6 of cloth through the cloth spreading machine when the shutter is open.

Figure 2:
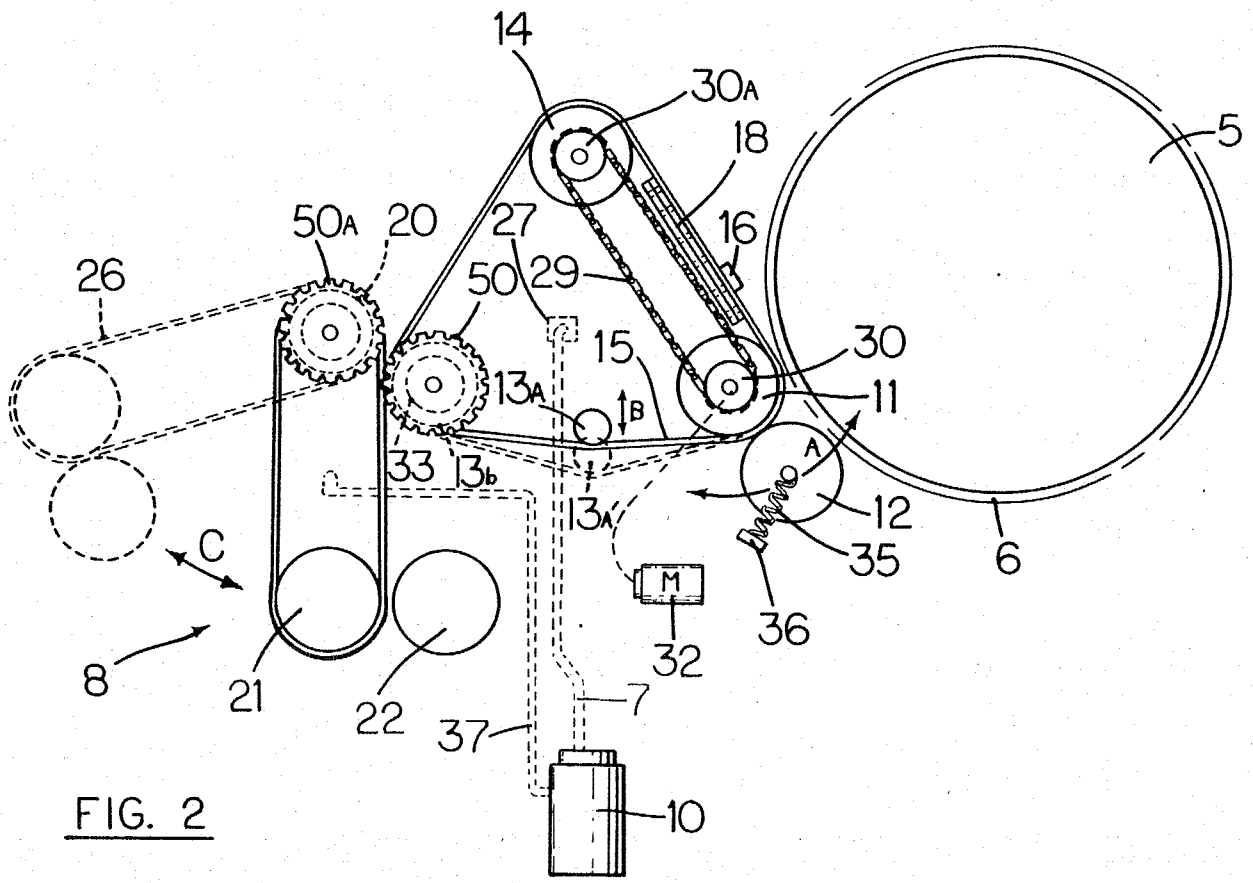
FIG. 2 is a diagrammatic side view of the cloth supply feed mechanism and spreading unit.

The edge control means may comprise any conventional means, such as a pair of photoelectric sensor 16. The edge control means is positioned over the section of the belt 15 between rollers 11 and 14, as shown in FIGS. 1 and 2. The edge control means 16 provides appropriate signals to means (not shown) to axially shift the roll 5, as is known in the art (see U.S. Pat. No. 3,479,023 to Martin, for example). As illustrated in FIG. 3, the pair of photoelectric sensors 16 are mounted over the belt and near each side edge, by a pair of supports 16*b*. A turnbuckle shaft 16*c* (having oppositely threaded portions) mechanically couples both supports so that rotation of the turnbuckle shaft simultaneously shifts both photoelectric sensors 16 toward or away from one another. This assures that each photoelectric sensor is positioned the same distance from the center of the belt. Turnbuckle shaft 16*c* may be driven by an operator or by a motor.

The feed roller 12 is spring loaded by positioning a pair of springs 35, one of which is shown, against the axle of roller 12 and anchoring the spring to an appropriate portion 36 of the cloth supply feed mechanism 4. The feed roller 12 is connected to roller 11 by a pair of arms, one of which is shown at 19, so that it will travel through an arc as indicated by arrow A. The springs 35 assure that the roller 12 will remain in constant contact with the roll 5 of cloth and maintain sufficient pressure against the roll to provide proper feeding of the web 6 of cloth.

Figure 5:
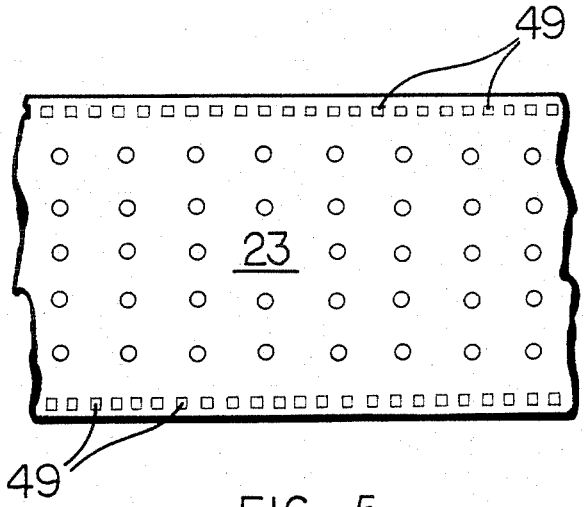
FIG. 5 is a fragmentary plan view of the endless belt of the spreading unit.

Near the front of the frame 1 and adjacent the cloth supply feed mechanism 4 is the spreading unit 8, consisting basically of three rollers 20, 21 and 22, a perforated belt 23, vacuum means 10 (including conduit 37) and elevator means 24. The perforated belt 23 is made of the same material as belt 15 and is generally the same width. Each edge of belt 23 includes indexing slots 49, as shown in FIG. 5. The perforated belt 23, mounted between a pair of end walls 40 (one of which is shown in FIG. 1), surrounds the rollers 20 and 21 which are a fixed distance one from the other. As illustrated in FIG. 2, roller 20 has a pair of sprockets 50*a* (one of which is shown) at each end of the roller. Roller 13*b* has a pair of sprockets 50 (one of which is shown) at each end of the roller. Sprockets 50 and 50*a* have their diameters substantially the same as the diameters of their respective rollers 13*b* and 20. The spreading unit 8 is mounted adjacent the cloth supply mechanism 4 so that the indexing slots 49 of belt 23 securely engage the sprockets 50 of roller 13*b*. Moreover, slots 49 also engage sprockets 50*a*. This assures that the rollers 20 and 21 will be driven by roller 13*b* and will rotate at the same speed as roller 13*b* through the agency of belt 23 and its indexing slots 49. Roller 22 is free wheeling and rotates because of its close contact with roller 21.

A vacuum is applied to the volume bound by the belt 23 and end walls 40, by means of an opening 37*a* in one of the end walls 40 and conduit 37 connected to vacuum means 10. Thus, a vacuum is drawn through perforated belt 23 to hold the cloth on the belt. The two rollers 20 and 21 are connected by L-shaped connecting links 25 (one of which is illustrated in FIG. 1) to roller 22; the lower surface of roller 22 is on the same plane as that of roller 21 to provide for spreading cloth in either direction. The spreading unit 8 is made to swing out of the position shown, as indicated by arrow C and the broken lines at 26 in FIG. 2, so that the machine may be rotated on its frame 1, if desired.

Figure 4:
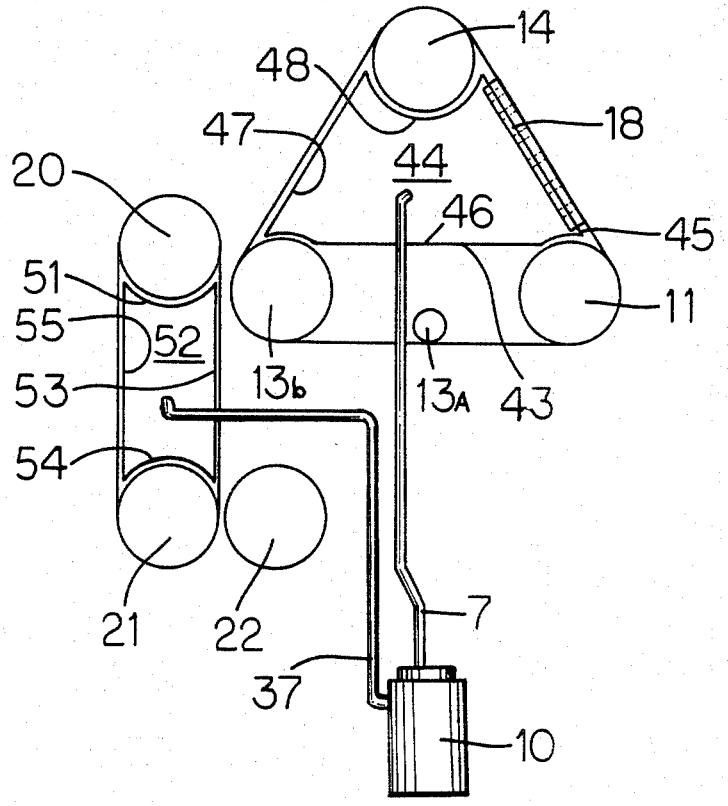
FIG. 4 is a diagrammatic side view of a modification of the cloth spreading mechanism.

The elevator means 24 comprises a pair of pinion gears 38 and racks 39, one of which is shown in FIG. 1, to raise the spreading unit 8. The pair of pinion gears 38 freely rotate on shaft 41. The spreading unit is raised by means of a ratchet system, or a motor, or the like, not shown. Conventionally known ratchet systems are taught by U.S. Pat. Nos. 3,479,023 and 4,392,646 (FIG. 4).

Operation of the cloth spreading machine of the present invention is commenced by first loading the roll 5 of cloth into the loader throat 9. The web 6 from the roll 5 is brought into contact with the feed roller 12. The rollers 11–14, 20–22 and the vacuum means 10 are activated with the shutter 18 open so that the web 6 will be drawn to the belt 15 and subsequently to the belt 23, thus feeding through the cloth spreading machine. Once the cloth is initially fed onto belt 15, the machine is temporarily deactivated so that the edge control means 16 may be properly positioned and the shutter 18 closed, and the machine reactivated for operation.

The wheels 2 are timed with the cloth supply feed mechanism 4 so that the machine moves along the table 3 at the same rate as the web 6 of cloth is laid. The roll 5 is rotated by feed rollers 11 and 12 to make the web 6 of cloth available. The web 6 advances through the edge control means 16; if an out-of-line condition is sensed, the roll 5 will be axially adjusted to position the web 6, as is conventionally known. The web 6 is then drawn against the belt 15 at perforated roller 14 by the air pull produced by the vacuum means. The overlying material is made to contract as it passes through the contraction section of the belt 15 between rollers 14 and 13*b*, as previously discussed. This removes any tension in the web 6 that might exist due to the manner in which the roll 5 was wound at the mill. As the web 6 comes in contact with the perforated belt 23, the vacuum drawn from within the spreading unit 8 pulls the web against the belt 23. The web remains in contact with the belt 23 until it passes over roller 21 or 22, depending on the direction of travel of the machine. Thus, a straight edge is maintained from the time the web 6 is positioned by the edge control means 16 until it is laid onto the spreading table 3.

Upon completion of the lay of the web 6 of cloth, the elevator means 24 is activated to raise the spreading unit 8 an increment substantially equal to the thickness of the web 6 of cloth just laid. At this point, the direction of motion of the cloth spreading machine may be immediately reversed, thus spreading cloth in both directions, if desired. Depending upon the type of cloth, it may be desirable to rotate the cloth spreading machine on frame 1 before reversing the machine in order to assure that the weave or nap of the cloth, for example, corduroy, is in proper relationship when the pattern is cut.

The rolls 5 of cloth are generally 60 inches in width, but some types of cloth may be as small as 42 inches in width, for example. In prior art devices, only one edge control is employed, such that the smaller widths of cloth are not centered with respect to the cloth feed mechanism. This means that prior art devices must shift their cloth feed mechanism with respect to the frame in order to lay the cloth in layers on top of one another.

The present invention employes two photoelectric sensors, one on each side of the belt, which are always spaced an equal distance from the center of the belt. Moreover, the photoelectric sensors can accommodate any width of cloth because the turnbuckle shaft 16*c* can always accurately position the edge control means. Thus, with the present invention, the cloth is always centered on the belts because of the edge control means. Therefore, it is unnecessary to shift the cloth feed mechanism 4 on the frame 1 in order to place each successive layer of cloth upon one another, when spreading cloth like corduroy, for example.

Modifications of the invention may be made without departing from the spirit of it. For example, FIG. 4 discloses another vacuum system which may be employed in the device of the present application. Instead of creating a vacuum chamber by means of belt 15 and end walls 34, FIG. 4 illustrates an enclosed housing vacuum system formed of, for example, sheet metal, plastic or the like. The enclosed housing 43 comprises a solid bottom wall 46 between rollers 11 and 13*b*, a perforate upwardly sloping wall 47 between rollers 13*b* and 14, another upwardly sloping wall 45 between rollers 11 and 14 in which shutter 18 is located, a perforated arcuate segment 48 adjacent perforated roll 14 and a pair of solid end walls 44, only one of which is illustrated. Conduit 7, which is attached to vacuum means 10, is in communication with one of the end walls 44.

In operation, vacuum means 10 can draw a suction on housing 43, which in turn draws a suction on belt 15 through perforate wall 47, arcuate segment 48 and, if desired, through shutter 18 when it is in the open position as shown. No vacuum is drawn through bottom wall 46 or end walls 44 since these walls are solid.

An enclosed housing is also illustrated between rolls 20 and 21 which comprises two arcuate segments 51 and 54, two end walls, one of which is shown at 52, and two vertical walls 53 and 55. Only wall 53 is perforated so that a vacuum is drawn on belt 23 between rollers 20 and 21.

Although belt 15 encircles rollers 11, 13*b* and 14 forming a triangular shape, an oblong shape formed without the perforated carrier roller 14 is within the scope of the present invention. In such an arrangement, belt 15 encircles rollers 11 and 13*b*, and the tension adjustment roller 13*a* is employed between rollers 11 and 13*b*, just as it is positioned in the triangular arrangement. When the tension adjustment roller 13*a* is fully extended, the belt 15 is stretched to its limit as previously, explained. When roller 13*a* is retracted, the temporary slack in belt 15 causes roller 13*b* to momentarily stop due to the frictional clutch. Driven roller 11 quickly transfers the slack to the cloth conveying flight, thus creating a condensing portion. The cloth conveying flight transfers the cloth from the roll of cloth to the cloth spreading unit in a tensionless manner as discussed with respect to the triangular arrangement.

Another modification of the invention includes employing the cloth supply feed mechanism 4 on a cloth inspection machine having a supply roll for the cloth, a light plate to enhance the defects of the cloth, and a take-up roll, as is conventional in the art. For example, the cloth supply feed mechanism may be employed between the light plate and the take-up rolls to relieve the tension in the fabric typically created by the mill. In this manner, the cloth inspection machine would not only inspect the cloth in the well known manner, but it would also relieve the tension in the cloth so that conventional cloth spreading machines may be employed without encountering the problems set forth in the initial portions of the present application.

What is claimed is:

1. A machine for spreading cloth from a roll thereof upon an elongated table comprising:

a frame having wheels mounted on said table for longitudinal movement thereon;

a cloth supply feed mechanism mounted on said frame and including means to support said roll of cloth, an expansible perforated endless first belt for conveying said cloth from said roll, means for drawing a vacuum through said first belt to maintain alignment of said cloth thereon, said endless first belt having a portion capable of condensing said cloth; and a spreader unit mounted on said frame for receiving cloth from said cloth condensing portion of said first belt and depositing said cloth on said table.

2. The machine claimed in claim 1, wherein said spreader unit comprises a second endless belt and means for drawing a vacuum to maintain the alignment of said cloth on said second belt and for maintaining the cloth in the condensed condition.

3. The machine claimed in claim 1, wherein said cloth feed mechanism comprises:

a feed roller to control the rate at which the cloth is removed from the roll;

first and second tension adjustment rollers;

said first perforated belt passing about said feed roller and said first tension adjustment roller with a non-slipping engagement forming cloth carrying and return flights therebetween;

said second tension adjustment roller being shiftably mounted between a normal position adjacent said return flight and an actuated position engaging and stretching said return flight;

means to shift second tension adjustment roller between said normal and said actuated positions;

means to drive said feed roller at a constant speed;

a friction clutch in association with said first tension adjustment roller so that said first tension adjustment roller is rotated by said belt only;

whereby when said second adjustment roller is positioned from said normal position to said actuated position, said return flight of said first belt is stretched, and when said second adjustment roller is rapidly returned to its normal position, said first adjustment roller is momentarily stopped, causing the stretch of said return flight to be taken up by said feed roller and slack is created in said cloth carrying flight converting said cloth carrying flight to said condensing portion.

4. The machine claimed in claim 1, wherein said roll of cloth is mounted on an axial shaft, said cloth feed mechanism having a pair of side walls, said side walls each including a loader throat to guide the axial shaft of said roll of cloth, said throat being slightly inclined so as to employ the force of gravity to advance the roll of cloth against said cloth feed mechanism as the cloth is removed, said incline being limited so that said throat will support the majority of the weight of said roll of cloth.

5. The machine claimed in claim 3, wherein said spreader unit comprises a pair of spaced apart spreader unit rollers; an second endless belt being perforated and passing about said spreader unit rollers with a non-slipping engagement, forming a cloth carrying flight and a return flight therebetween; and means to drive said second endless belt about said spreader unit rollers.

6. The machine claimed in claim 5, wherein said spreader unit rollers include indexing means on said second endless belt, a first pair of sprockets mounted at the ends of one of the spreader unit rollers and engaging said indexing means, a second pair of sprockets mounted at the ends of said first tension adjustment roller and engaging said indexing means, whereby rotation of said first tension adjustment roller and said second pair of sprockets thereon drives said second endless belt around said spreader unit rollers.

7. The machine claimed in claim 5, including means for drawing a vacuum through said cloth carrying flight of said second belt, said means comprising a vacuum housing located within said second endless belt and between spreader unit rollers, said housing further including an opening fluidly connected to said means for drawing a vacuum, said housing being opened adjacent said cloth carrying flight.

8. The machine claimed in claim 1, wherein said cloth supply feed mechanism comprises:

a feed roller to control the rate at which the cloth is removed from the roll;

a perforated carrier roller;

first and second tension adjustment rollers;

said first perforated belt passing about said feed roller, said perforated carrier roller, and said first tension adjustment roller with a non-slipping engagement forming a first cloth carrying flight between said feed roller and said perforated carrier roller, a second cloth carrying flight formed between said perforated carrier roller and said first tension adjustment roller, and a return flight formed between said first tension adjustment roller and said feed roller;

said second tension adjustment roller being shiftably mounted between a normal position adjacent said return flight and an actuated position engaging and stretching said return flight;

means to shift said second tension adjustment roller between said normal and said actuated positions;

means to drive said feed roller at a constant speed;

a friction clutch in association with said first tension adjustment roller so that said first tension adjustment roller is rotated by said belt only;

whereby when said second adjustment roller is shifted from said normal position to said actuated position, said return flight of said first belt is stretched, and when said second adjustment roller is rapidly returned to its normal position, said first adjustment roller is momentarily stopped, causing the stretch of said return flight to be taken up by said feed roller and said perforated carrier roller, and slack is created in said second cloth carrying flight converting said second cloth carrying flight to said condensing portion.

9. The machine claimed in claim 8, wherein said feed roller and said perforated carrier roller are simultaneously driven by means of a pair of sprockets attached to each of said rollers and a chain which encircles each of said sprockets; and a drive means to drive one of said perforated carrier roller and said feed roller.

10. The machine claimed in claim 8, wherein said cloth feed mechanism has a pair of end walls with said rollers positioned therebetween, wherein said means for drawing a vacuum draws said vacuum in the space bound by said pair of said end walls and said first endless belt.

11. The machine claimed in claim 8, wherein said means for drawing a vacuum includes a vacuum housing positioned within said endless belt, said vacuum housing being opened adjacent said perforated carrier roller and second cloth carrying flight, said vacuum housing having an openable and closable shutter assembly adjacent said first cloth carrying flight.

12. The machine claimed in claim 1, wherein said first endless belt includes at least one limit strap which limits the expansion of said first belt and does not interfere with the contraction of said first belt.

13. The machine claimed in claim 1, wherein said spreader unit includes an elevator means for incrementally raising said spreader unit an amount substantially equal to the thickness of cloth spread upon said elongated table.

14. The machine claimed in claim 13, wherein said elevator means includes a pinion gear mounted on said spreading unit and a rack mounted on said cloth feeding mechanism so that said spreader unit is mounted on said cloth feeding mechanism so that said pinion gear engages said rack, further including a ratchet system for integrally raising said elevator means a distance substantially equal to the thickness of said cloth spread upon said elongated table.

15. The machine claimed in claim 8, wherein said roll of cloth is mounted on said axial shaft, said cloth feed mechanism having a pair of side walls, said side walls each include a loader throat to guide the axial shaft of said roll of cloth, said throat being slightly inclined so as to employ the force of gravity to advance the roll of cloth against said cloth feed mechanism as the cloth is removed, said incline being limited so that said throat will support the majority of the weight of said roll of cloth.

16. The machine claimed in claim 8, wherein said spreader unit comprises a pair of spaced apart spreader unit rollers; a second endless belt being perforated and passing about said spreader unit rollers with a non-slipping engagement, forming a cloth carrying flight and a return flight therebetween, and means to drive said second endless belt about said spreader unit rollers.

17. The machine claimed in claim 16, wherein said means to drive spreader unit rollers includes indexing means on said second endless belt, a first pair of sprockets mounted at the ends of one of said spreader unit rollers and engaging said indexing means, a second pair of sprockets mounted at the ends of said first tension adjustment roller and engaging said indexing means, whereby rotation of said first tension adjustment roller and said second pair of sprockets thereon drives said second endless belt around said spreader unit rollers.

18. The machine claimed in claim 16, including means for drawing a vacuum through said cloth carrying flight of said second belt, said means comprising a vacuum housing located within said endless belt and between said spreader unit rollers, said housing further including an opening fluidly connected to said means for drawing a vacuum, said housing being open adjacent said cloth carrying flight.

19. The machine claimed in claim 8, wherein said first endless belt includes at least one limit strap which limits the expansion of said first belt and does not interfere with the contraction of said first belt.

20. The machine claimed in claim 8, wherein said spreader unit includes an elevator means for incrementally raising said spreader unit an amount substantially equivalent to the thickness of said cloth spread upon said elongated table.

21. The machine claimed in claim 3, wherein said first endless belt includes at least one limit strap which limits the expansion of said first belt and does not interfere with the contraction of said first belt.

22. The machine claimed in claim 3, wherein said spreader unit includes an elevator means for incrementally raising said spreader unit an amount substantially equivalent to the thickness of said cloth spread upon said elongated table.

23. A cloth supply feed mechanism for removing tension from cloth obtained from a supply of cloth comprising:

a feed roller to control the rate at which the cloth is removed from said supply of cloth;

a perforated carrier roller;

first and second tension adjustment rollers;

a perforated endless belt;

said perforated belt passing about said feed roller, said perforated carrier roller, and said first tension adjustment roller with a non-slipping engagement forming a first cloth carrying flight between said feed roller and said perforated carrier roller, a second cloth carrying flight formed between said perforated carrier roller and said first tension adjustment roller, and a return flight formed between said first tension adjustment roller and said feed roller;

said second tension adjustment roller being shiftably mounted between a normal position adjacent said return flight and an actuated position engaging and stretching said return flight;

means to shift said second tension adjustment roller between said normal and said actuated positions;

means to drive said feed roller at a constant speed;

a friction clutch in association with said first tension adjustment roller so that said first tension adjustment roller is rotated by said belt only;

whereby when said second adjustment roller is shifted from said normal position to said actuated position, said return flight of said perforated belt is stretched, and when said second adjustment roller is rapidly returned to its normal position, said first adjustment roller is momentarily stopped, causing the stretch of said return flight to be taken up by said feed roller and said perforated carrier roller, and slack is created in said second cloth carrying flight converting said second cloth carrying flight to said condensing portion.

24. The mechanism claimed in claim 23, wherein said feed roller and said perforated carrier roller are simultaneously driven by means of a pair of sprockets attached to each of said rollers and a chain which encircles each of said sprockets; and a drive means to drive one of said perforated carrier roller and said feed roller.

25. The mechanism claimed in claim 23, wherein said cloth supply feed mechanism has a pair of end walls with said rollers positioned therebetween, and means for drawing a vacuum in the space bound by said pair of end walls and said perforated endless belt.

26. The mechanism claimed in claim 25, wherein said means for drawing a vacuum includes a vacuum housing positioned within said endless belt, said vacuum housing being opened adjacent said perforated carrier roller and said second cloth carrying flight, said vacuum housing having an openable and closable shutter assembly adjacent said first cloth carrying flight.

27. The mechanism claimed in claim 23, wherein said endless belt includes at least one limit strap which limits the expansion of said belt and does not interfere with the contraction of said belt.

28. A cloth supply feed mechanism for removing tension from cloth obtained from a supply of cloth comprising;

a feed roller to control the rate at which the cloth is removed from said supply of cloth;

first and second tension adjustment rollers;

a perforated endless belt;

said perforated belt passing about said feed roller and said first tension adjustment roller with a non-slipping engagement forming cloth carrying and return flights therebetween;

said second tension adjustment roller being shiftably mounted between a normal position adjacent said return flight and an actuated position engaging and stretching said return flight;

means to shift said second tension adjustment roller between said normal and said actuated positions;

means to drive said feed roller at a constant speed;

a friction clutch in association with said first tension adjustment roller so that said first tension adjustment roller is rotated by said belt only;

whereby when said second adjustment roller is positioned from said normal position to said actuated position, said return flight of said belt is stretched, and when said second adjustment roller is rapidly returned to its normal position, said first adjustment roller is momentarily stopped, causing the stretch of said return flight to be taken up by said feed roller and slack is created in said cloth carrying flight converting said cloth carrying flight to said condensing portion.

29. The mechanism claimed in claim 28, wherein said endless belt includes at least one limit strap which limits the expansion of said belt and does not interefere with the contraction of said belt.

30. The mechanism claimed in claim 28, wherein said mechanism has a pair of end walls with said rollers positioned therebetween, and means for drawing a vacuum in the space bound by said pair of end walls and said perforated endless belt.

* * * * *